United States Patent [19]

Janssen

[11] Patent Number: 4,932,881

[45] Date of Patent: Jun. 12, 1990

[54] TRENCHER TOOTH PATTERN DEMONSTRATION FIXTURE AND METHOD

[75] Inventor: Robert H. Janssen, Aberdeen, S. Dak.

[73] Assignee: Clark Equipment Company, South Bend, Ind.

[21] Appl. No.: 375,585

[22] Filed: Jul. 5, 1989

[51] Int. Cl.[5] ..... G09B 25/02

[52] U.S. Cl. ..... 434/401; 40/124; 211/40

[58] Field of Search ..... 434/401, 433, 429, 403; 40/124, 124.4; 211/40, 41, 42, 44, 46; 248/473

[56] References Cited

U.S. PATENT DOCUMENTS

| | | | |
|---|---|---|---|
| 2,288,317 | 5/1940 | Greenberg | 211/40 |
| 4,684,132 | 8/1987 | Wolford | 40/124 X |
| 4,685,647 | 8/1987 | Calhoun | 248/273 X |
| 4,712,679 | 12/1987 | Lowe | 211/40 X |

OTHER PUBLICATIONS

Melroe Company, Trencher Chain Manual, Revised Jun. 1989, 52 pages.

Vermeer Manufacturing Company, "VH-18 Trencher Attachment", Operator's Manual with Parts Lists, Revised Apr. 1986, Title pp. & pp. 0-1, 0-2, 6-1 & 6-2.

J. I. Case, "Digging Chain and Teeth", Parts Catalog H15651, Sep. 1981, pp. ii, iii, 5-1, 5-2, 8-1 and 8-2.

*Primary Examiner*—Richard J. Apley
*Assistant Examiner*—Rachel M. Healey
*Attorney, Agent, or Firm*—Kinney & Lange

[57] ABSTRACT

A trencher tooth pattern demonstration fixture for simulating positions of trencher teeth on an elongated trencher chain having a plurality of pitches spaced about the length of the chain. The demonstration fixture includes an elongated base having an elongated opaque indicia representative of the trencher chain and transverse pitch indicia representative of trencher chain pitches. A plurality of trencher tooth receiving slots are formed in the base adjacent the pitch indicia at spaced positions on opposite sides of the chain indicia. Trencher teeth are positioned in the slots in a desired pattern with respect to the chain and pitch indicia for visual evaluation and display.

18 Claims, 1 Drawing Sheet

TRENCHER TOOTH PATTERN DEMONSTRATION FIXTURE AND METHOD

BACKGROUND OF THE INVENTION

1. Field of the Invention

The present invention relates generally to the field of machine powered trenchers utilizing a trencher chain. In particular, the present invention is a device and method for simulating and demonstrating patterns of teeth or cutters to be mounted to the trencher chain.

2. Description of the Prior Art.

Walk-behind and ride trenchers are in widespread use. These trencher implements include a sprocket driven endless chain which is supported on a boom assembly. The chain is formed by a plurality of links or pitches. Teeth, also sometimes called cutters, are bolted to the chain in a pattern selected as a function of soil conditions and the desired trench width. Spacers or spreaders are used to transversely space some of the teeth from the chain to achieve wider trenching capabilities. Depending upon the lengths of the pattern and chain, the pattern can be repeated several times.

The pattern in which the trencher teeth are mounted to the chain is typically dependent upon soil conditions and desired cutting width. No standard patterns are used in the industry. Patterns recommended by trencher manufacturers are generally described in charts and/or diagrammatic and pictorial illustrations.

It is sometimes necessary to develop a nonstandard trencher tooth pattern. While trial and error techniques will generally produce a suitable result, this approach can be inefficient since it takes time to bolt the trencher teeth onto the chain. It is therefore evident that there is a need for an improved system for the development of trencher teeth patterns which will produce the most efficient digging operations under the conditions presented.

SUMMARY OF THE INVENTION

The present invention is a trencher tooth pattern demonstration fixture for simulating positions of trencher teeth on an elongated trencher chain having a plurality of pitches spaced about the length of the chain. The fixture includes a base and supports. The base has a longitudinal axis representative of the trencher chain and a plurality of spaced pitch positions along the axis representative of trencher chain pitches. The supports releasably receive and support trencher teeth at a plurality of positions on opposite sides of the longitudinal axis at the pitch positions.

In preferred embodiments the supports include trencher teeth receiving slots in the base. An elongated opaque marking on the base functions as a chain indicia, while transverse markings function as pitch indicia. With this demonstration fixture, trencher teeth can be quickly and conveniently set up in different patterns for evaluation, simulation and display.

DETAILED DESCRIPTION OF THE PREFERRED EMBODIMENTS

Figure 1:
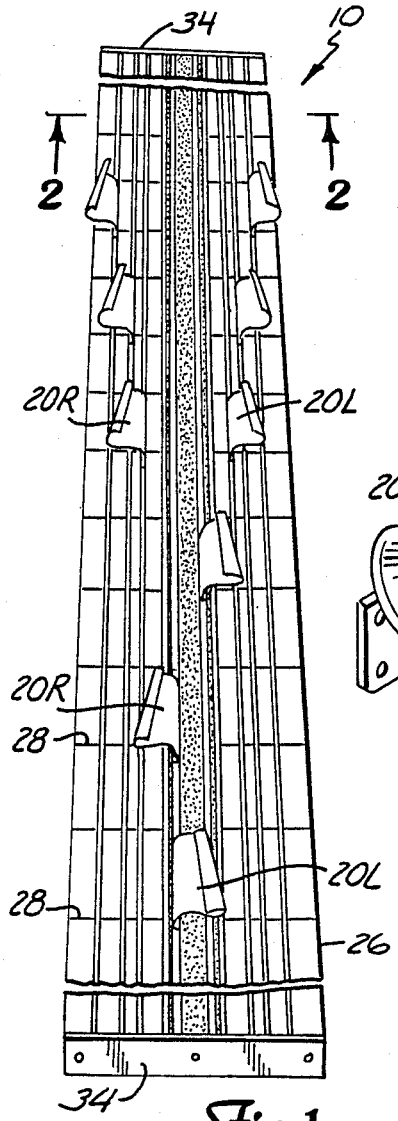
FIG. 1 is an illustration of a trencher tooth pattern demonstration fixture in accordance with the present invention.
Figure 3:
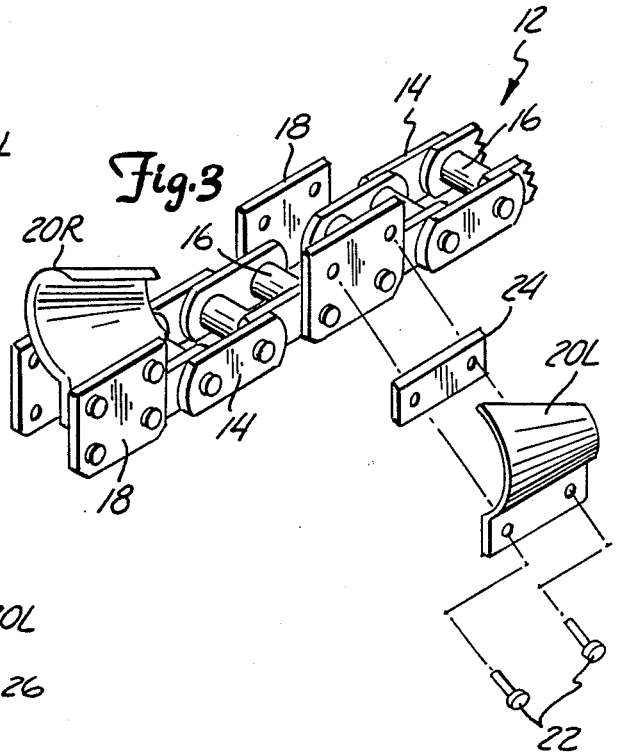
FIG. 3 is a partially exploded fragmentary view of a conventional trencher chain.
Figure 2:
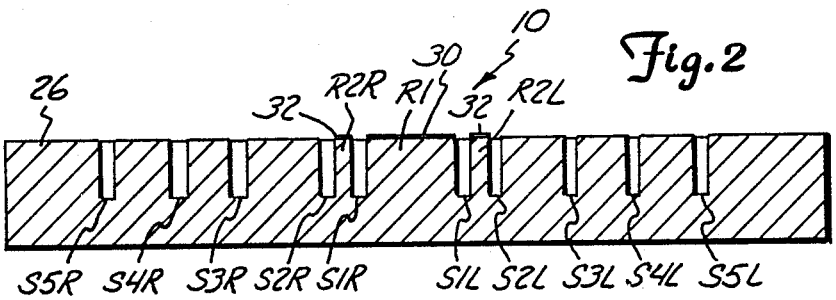
FIG. 2 is a sectional view of the demonstration fixture, taken along lines 2—2 in FIG. 1.

A trencher tooth pattern demonstration fixture 10 in accordance with the present invention is illustrated generally in FIGS. 1 and 2. Fixture 10 is used to simulate, demonstrate and display the positions of cutters or teeth to be mounted to a chain on a trencher boom. The description of fixture 10 and its method of use will be facilitated by an understanding of a conventional trencher chain such as that illustrated at 12 in FIG. 3.

Trencher chain 12 is an elongated member formed by rollers 16, standard links 14 and tooth station links 18. In addition to coupling adjacent rollers 16, tooth station links 18 have a pair of holes through which right hand teeth 20R and left hand teeth 20L can be fastened by bolts 22 and associated nuts (not shown). Right hand teeth 20R and left hand teeth 20L can be mounted to either side of chain 12 and to either side of links 18. Spacers such as 24 can be used to space some teeth 20R and 20L from chain 12 to obtain a desired cutting width (only one tooth 20L is shown attached with a spacer 24 in FIG. 3). The distance between adjacent rollers 16 is characterized as a pitch. Teeth 20R and 20L are usually attached to chain 12 at every second or fourth pitch. In the embodiment shown in FIG. 3, teeth 20R and 20L are spaced from one another by four pitches. Typically, a pattern of teeth 20R and 20L at adjacent pitches and different spacings from chain !2 is developed as a function of criteria such as soil conditions and desired cutting width. The pattern is then repeated over the length of the chain 12.

As illustrated in FIGS. 1 and 2, display fixture 10 includes an elongated base 26 having a plurality of transversely spaced and parallel pairs of right and left slots S1R and S1L, S2R and S2L, S3R and S3L, S4R and S4L and S5R and S5L. Each pair of slots S1R and S1L–S5R and S5L is centered on base 26 about an elongated central ridge R1. Ridge R1 has a width which is approximately equal to that of roller 16, and represents the center of a chain. A pair of ridges R2R and R2L are spaced from central ridge R1 by slots S1R and S1L, respectively, and represent the position of links of a trencher chain. In the embodiment shown in FIG. 2, coatings 30 and 32 of black paint are applied to upper surfaces of ridges R1, R2R and R2L to function as indicia of a trencher chain.

In one embodiment central ridge R1 has a width of 1.2 inches. Slots S1R and S1L–S5R and S5L are approximately 0.3 inches in width and 0.75 inches in depth. The inside edges of slots S2R and S2L–S5R and S5L are spaced from the center of central ridge R1 by distances of 1.2, 2.2, 3.0 and 4.0 inches, respectively. These distances represent the distances that teeth 20R and 20L can be spaced from a chain such as 12 using spacers 24 of different widths.

As shown in FIG. 1, demonstration fixture 10 also includes opaque transverse lines 28 which function as pitch indicia and represent the pitches a chain. The embodiment shown in FIG. 1 is approximately thirteen pitches in length. A display fixture 10 of this length will generally be sufficient to simulate a single pattern of trencher teeth 20R and 20L. Longer bases 26 can be used if it is desired to demonstrate a repeated pattern.

In one embodiment base 26 is a $2\times12$ inch piece of wood in which continuous slots SIR and S1L–S5R and S5L are cut using a saw. With the exception of paint coatings 30 and 32 and lines 28, base 26 is painted white to enhance its ornamental appearance. Pieces of angle iron 34 are mounted to wooden base 26 to add rigidity and prevent bowing which may otherwise be caused by slots S1R and S1L–S5R and S5L.

To use demonstration fixture 10, trencher teeth 20R and 20L are positioned at the desired width in slots SIR and S1L–S5R and S5L at desired pitch indicia lines 28. Teeth 20R and 20L are releasably received and supported in the slots. Different patterns of trencher teeth can be conveniently set up, simulated, evaluated and displayed using fixture 10. By so doing, patterns of teeth 20R and 20L which will produce the most efficient digging operations in different soil conditions can be developed. Simulating patterns of teeth 20R and 20L before the teeth are attached to chain !2 also saves time.

Although the present invention has been described with reference to preferred embodiments, workers skilled in the art will recognize that changes may be made in form and detail without departing from the spirit and scope of the invention.

What is claimed is:

1. A trencher tooth pattern demonstration fixture for simulating positions of trencher teeth on an elongated trencher chain having a plurality of pitches spaced about the length of the chain, the demonstration fixture including:

a base having a longitudinal axis representative of a trencher chain and a plurality of spaced pitch positions along the axis representative of trencher chain pitches; and supports on the base for releasably receiving and supporting trencher teeth at a plurality of transversely spaced positions on opposite sides of the longitudinal axis and at the pitch positions.

2. The demonstration fixture of claim 1 wherein the supports include slots in the base.

3. The demonstration fixture of claim 2 wherein the base includes a wood base.

4. The demonstration fixture of claim 3 and further including rigid transverse members mounted to the wood base.

5. The demonstration fixture of claim and further including chain indicia on the base to represent a trencher chain.

6. The demonstration fixture of claim 5 wherein the chain indicia includes an elongated opaque marking.

7. The demonstration fixture of claim and further including pitch indicia on the base to represent trencher chain pitches.

8. The demonstration fixture of claim 7 wherein the pitch indicia includes transverse opaque markings.

9. The demonstration fixture of claim 1 wherein the trencher chain pitches have a pitch length and the base is at least ten pitch lengths in length.

10. A trencher tooth pattern demonstration fixture for simulating the positions of trencher teeth on an elongated trencher chain having a plurality of pitches spaced about the length of the chain, the demonstration fixture including:

a base having a longitudinal axis representative of a trencher chain and a plurality of spaced pitch positions along the axis representative of trencher chain pitches; and support means on the base for releasably receiving and supporting trencher teeth at a plurality of transversely spaced positions on opposite sides of the longitudinal axis and at the pitch positions.

11. The demonstration fixture of claim 10 wherein the support means includes slots in the base.

12. The demonstration fixture of claim 10 and further including chain indicia on the base representative of a trencher chain.

13. The demonstration fixture of claim 10 and further including pitch indicia on the base representative of trencher chain pitches.

14. A trencher tooth pattern demonstration fixture for simulating the positions of trencher teeth on an elongated trencher chain having a plurality of pitches spaced about the length of the chain, the demonstration fixture including:

an elongated base;

a chain indicia on the base representative of the trencher chain;

pitch indicia on the base representative of trencher chain pitches; and a plurality of trencher tooth receiving slots in the base adjacent the pitch indicia at transversely spaced positions on opposite sides of the chain indicia.

15. The demonstration fixture of claim 14 wherein the chain indicia includes an elongated opaque marking.

16. The demonstration fixture of claim 14 wherein the pitch indicia include transverse opaque markings.

17. A method for demonstrating a pattern of trencher teeth configured for mounting to a trencher chain having a plurality of spaced pitches, including:

providing a trencher tooth-receiving base having a longitudinal axis representative of a trencher chain; and positioning trencher teeth on the base with with respect to the longitudinal axis in a desired pattern.

18. The method of claim 17 wherein:

providing the base includes providing a base having a chain indicia representative of the trencher chain and pitch indicia representative of the chain pitches; and positioning the trencher teeth includes positioning the trencher teeth on the base at the desired pattern with respect to the chain and pitch indicia.

* * * * *

UNITED STATES PATENT AND TRADEMARK OFFICE

CERTIFICATE OF CORRECTION

PATENT NO. : 4,932,881

DATED : June 12, 1990

INVENTOR(S) : Robert H. Janssen

It is certified that error appears in the above-identified patent and that said Letters Patent is hereby corrected as shown below:

Claim 5, line 1:
Col. 3, line 44, delete "claim", insert

--claim 1--

Claim 7, line 1:
Col. 3, line 49, delete "claim", insert

--claim 1--

Signed and Sealed this

Seventeenth Day of September, 1991

*Attest:*

HARRY F. MANBECK, JR.

*Attesting Officer*

*Commissioner of Patents and Trademarks*